US006772905B2

(12) United States Patent
Cheng

(10) Patent No.: US 6,772,905 B2
(45) Date of Patent: Aug. 10, 2004

(54) PROTECTIVE CASE HINGE STRUCTURE

(76) Inventor: Chun Lung Cheng, 1786 Curtis Ct., La Verne, CA (US) 91750

( * ) Notice: Subject to any disclaimer, the term of this patent is extended or adjusted under 35 U.S.C. 154(b) by 195 days.

(21) Appl. No.: 09/994,043

(22) Filed: Nov. 23, 2001

(65) Prior Publication Data

US 2003/0098313 A1 May 29, 2003

(51) Int. Cl.[7] ..... B65D 43/16

(52) U.S. Cl. ..... 220/840; 16/355; 220/845; 220/846; 220/4.22

(58) Field of Search ..... 16/355, 327, 329, 16/332; 220/4.22, 4.23, 840, 845, 847, 841, 831

(56) References Cited

U.S. PATENT DOCUMENTS

| | | | | | |
|---|---|---|---|---|---|
| 2,302,661 | A | * | 11/1942 | Benson | 16/267 |
| 2,785,823 | A | * | 3/1957 | Zarges | 220/6 |
| 3,334,714 | A | * | 8/1967 | Gordon | 220/4.22 |
| 3,484,895 | A | * | 12/1969 | Mock | 16/356 |
| 3,663,990 | A | * | 5/1972 | Shane | 16/269 |
| 4,546,874 | A | * | 10/1985 | Kirchhan | 220/4.22 |
| 4,852,213 | A | * | 8/1989 | Shewchuk | 16/266 |
| 4,942,271 | A | * | 7/1990 | Corsi et al. | 174/101 |
| 4,967,924 | A | * | 11/1990 | Murofushi et al. | 220/3.8 |
| 5,329,667 | A | * | 7/1994 | Erskine | 16/269 |
| 5,622,012 | A | * | 4/1997 | Schijf | 52/71 |
| 5,915,446 | A | * | 6/1999 | De Zen | 160/235 |
| 6,145,165 | A | * | 11/2000 | Torcato | 16/355 |
| 6,499,188 | B1 | * | 12/2002 | Cheng | 16/355 |

FOREIGN PATENT DOCUMENTS

| | | | | | |
|---|---|---|---|---|---|
| JP | 63-149406 | A | * | 6/1988 | 16/355 |

* cited by examiner

*Primary Examiner*—Robin A. Hylton
(74) *Attorney, Agent, or Firm*—Raymond Y. Chan; David and Raymond Patent Group

(57) ABSTRACT

A case includes a case body, a case cover and a hinge structure. The hinge structure includes a first joint extended from a rear panel of the case body, a supporting arm having a front biasing surface and a rear biasing surface, and second joint which is extended from the rear wall of the case cover and has a holding slot to define a closed stopping surface and an opened stopping surface. The supporting arm is shaped and sized to slidably fit into the holding slot. Therefore, the supporting arm is slid outwardly from the holding slot until the rear biasing surface is biased against the closed stopping surface to close the case body with the case cover, and the supporting arm is slid into the holding slot until the front biasing surface is biased against the opened stopping surface to open the case body with the case cover.

8 Claims, 6 Drawing Sheets

PROTECTIVE CASE HINGE STRUCTURE

BACKGROUND OF THE PRESENT INVENTION

1. Field of Invention

The present invention relates to a hinge structure, and more particularly to a case hinge structure wherein the first and second joints are extended from two corresponding panels of the case and internally engaged with each other so as to protect the hinge structure for extending the service life span of the case and further minimizing the thickness of the panels of the case.

2. Description of Related Arts

Traditionally, a case 1 comprises a case body 1A and a case cover 1B pivotally connected to the case body 1A by means of a hinge 2, as shown in FIG. 1, wherein the hinge 2 comprises a pair of metal panels 3.4 each having a pin slot affixed on exterior surfaces of the case body 1A and the case cover 1B respectively, and a pin 5 coaxially inserted into the pin slots of the two metal panels 3.4 in such a manner that the case cover 1B is adapted for pivotally rotating so as to open up the case 1. However, such traditional hinge 2 has the following drawbacks:

(1) A user can only fold the case 1 cover 180 degrees from a closed position to an opened position such that the user cannot adjust a folding angle A of the case cover 1B, which is inconvenient for the user since the user may not able to keep the balance of the case 1 when opening the case 1. In order to keep the case cover 1B in a desired folding angle A, as shown in FIG. 2, a pivot arm 6 can be affixed between the case body 1A and the case cover 1B, as shown in FIG. 2. However, the product cost of the case 1 will be increased by adding parts into the case 1.

(2) Since the hinge 2 is affixed on the exterior bottom surface of the case 1, when the user carries the case 1, the hinge 2 may accidentally or unintentionally be damaged by collision or friction with the floor. Thus, the hinge 2 may destroy the aesthetic appearance of the case 1 as well.

(3) The pin 5 must be strong enough to pivotally connect the case body 1A and the case cover 1B together. Due to the external collision and the friction with the metal panels 3, 4, the pin 5 may wear out easily. So, when the pin 5 is broken, the locked case cover 1B can be opened at such hinged side edge. Since the hinges are non-replaceable, the case 1 is permanently broken and can't be repaired.

(4) The metal panels 3, 4 of the hinge 2 is affixed on the case 1 by means of rivets, which will damage the surface of the case 1, destroy the beauty appearance of the case 1 and increase the manufacturing cost of the case 1.

The case cover 1B is hard to tightly cover on top of the case body 1A due to the manufacturing deflection of the hinge. So, dust or rain may enter into the case 1 from a gap between the case body 1A and the case cover 1B.

SUMMARY OF THE PRESENT INVENTION

A main object of the present invention is to provide a case hinge structure which comprises a first and second joint integrally extended from two corresponding panels and internally engaged with each other, so as to protect the hinge structure and extend the service life span of the case.

Another object of the present invention is to provide a case hinge structure wherein since the first and second joints are integrally extended from the panels respectively, the thickness of the panels can be further reduced. In other words, the structure of the case is no longer restricted by the case hinge structure.

Another object of the present invention is to provide a case hinge structure wherein no pin or axle is needed in the pivot connection of the hinge structure, so as to prevent the pin or axle from being broken, which is the major and most easiest broken part of the conventional hinge structure.

Another object of the present invention is to provide a case hinge structure which can retain the case in the opened position with one or more inclined folding angles such that the case can be easily kept its balance.

Another object of the present invention is to provide a case hinge structure which is capable of tightly connecting the case cover with the case body together, so as to prevent a slit formed therebetween.

Another object of the present invention is to provide a case hinge structure which can keep an aesthetic appearance of the case since the hinge structure is inconspicuous and cannot be seen from outside.

Another object of present invention is to provide a case hinge structure wherein the case does not require to alter its original structural design so as to minimize the manufacturing cost of the case incorporating with the hinge structure Accordingly, in order to accomplish the above objects, the present invention provides a case, comprising:

a case body having a storage compartment;

a case cover adapted to enclose the storage compartment; and a hinge structure comprising:

a first joint, which is extended from a side of the case body, comprising a supporting arm having an arc-shaped cross-section and defining a holding slot therethrough; and a second joint, which is extended from a respective side of the case cover, having a pivot arm rotatably and coaxially received in the holding slot of the first joint.

According to a preferred embodiment of the present invention, the first joint and the second joint are coupled in such a manner that a friction is formed between the pivot arm and the supporting arm so as to adjust the folding angle of the case cover with respect to the case body when opening the case.

According to a preferred embodiment of the present invention, the first joint is extended from a side of the case body and comprises a support base and an arc-shaped supporting arm having an elongated support portion integrally extended from the support base and an enlarged end portion to define a front biasing surface provided at a front end of the end portion and a rear biasing surface outwardly extended between the support portion and the end portion.

According to a preferred embodiment of the present invention, the second joint is extended from the rear wall of the case cover and comprises an outer wall and an inner wall to form a corresponding arc-shaped holding slot therebetween, so as to define a closed stopping surface on the outer wall at an opening end of the holding slot and an opened stopping surface at a closed end thereof.

According to a preferred embodiment of the present invention, the supporting arm is shaped and sized to slidably fit into the holding slot so as to rotatably fold the case cover with respect to the case body between a closed position and an opened position, wherein in the closed position, the support portion of the supporting arm is slid out of the holding slot until the rear biasing surface of the supporting arm is biased against the closed stopping surface of the outer wall, and that in the opened position, the support portion of the supporting arm is slid into the holding slot until the front biasing surface of the supporting arm is biased against the opened stopping surface of the holding slot.

DETAILED DESCRIPTION OF THE PREFERRED EMBODIMENT

Referring to FIGS. 3 to 7, a case hinge structure 20 of a case 10 according to a preferred embodiment of the present invention is illustrated, wherein the case 10 comprises a case body 11 having a storage compartment and a case cover 12 comprising adapted to enclose the storage compartment.

Figure 5:
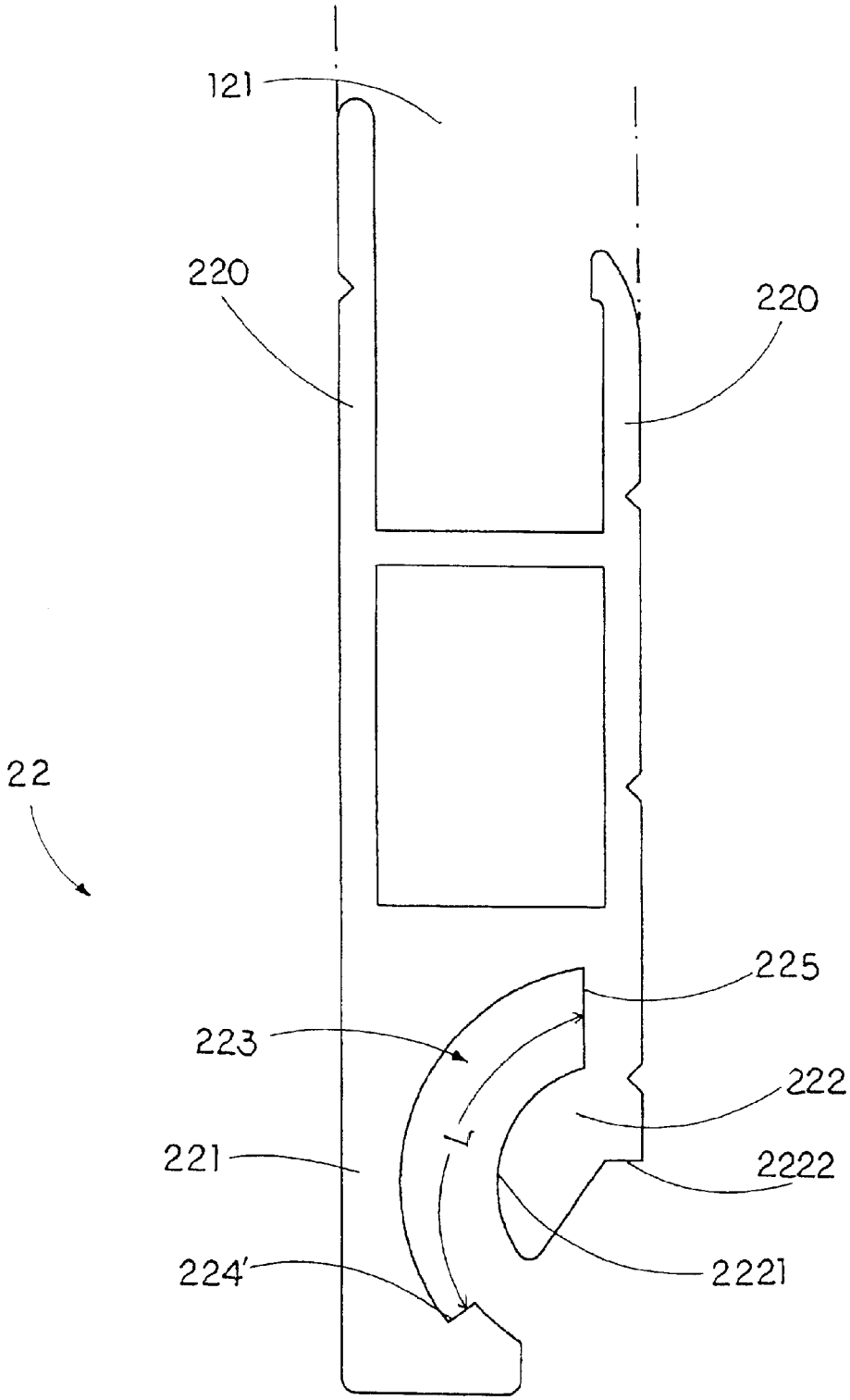
FIG. 5 is a sectional view of a second joint of the case hinge structure according to the above preferred embodiment of the present invention.

The hinge structure 20 comprises a pair of first and second joints 22, 21. As shown in FIG. 5, the first joint 22 is embodied here to be extended from a bottom edge of a rear wall 121 of the case cover 12 while the second joint 21 is embodied here to be extended from a top edge of a rear panel 111 of the case body 11, wherein the first and second joints 21, 22 are engaged with each other so as to foldably connect the case cover 21 with the case body 11. It is worth to mention that it would be an obvious alternative to have the first joint 21 extended from the top edge of the rear panel 111 of the base body 11 and the second joint 22 extended from the bottom edge of the rear wall 121 of the case cover 12.

Figure 1:
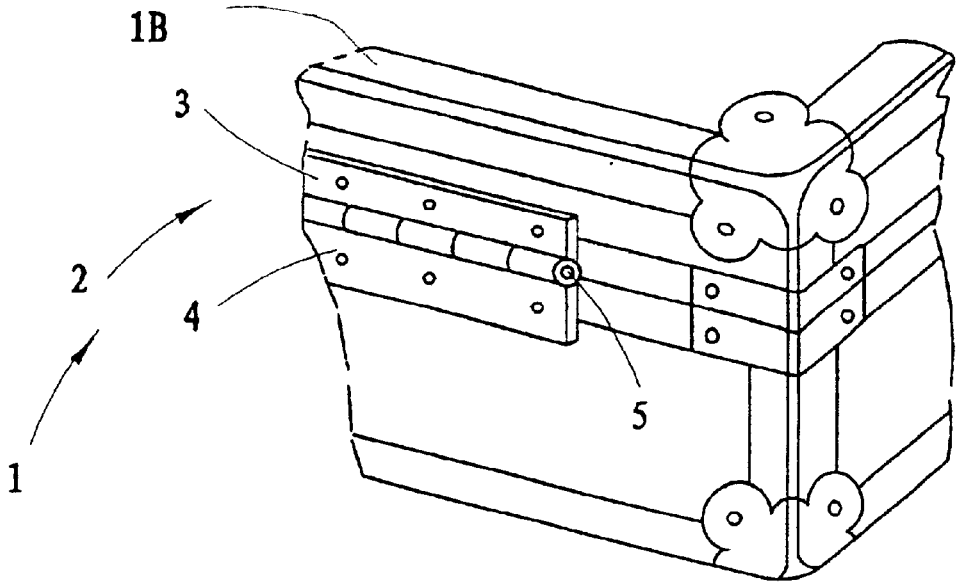
FIG. 1 PRIOR ART
FIG. 1 is a perspective view of a conventional hinge structure installed into a case.
Figure 2:
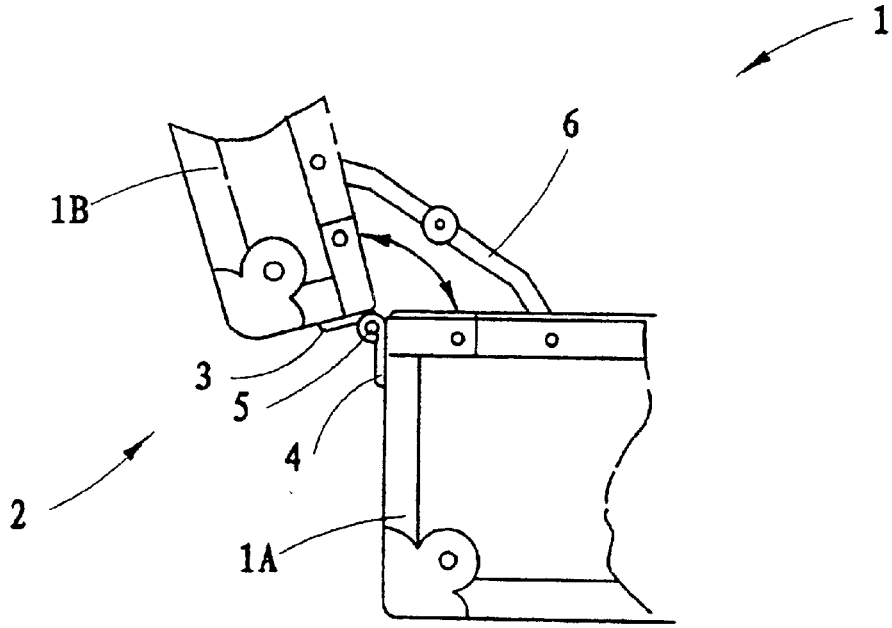
FIG. 2 PRIOR ART
FIG. 2 is a perspective view of the conventional hinge structure incorporated with a pivot arm.
Figure 3:
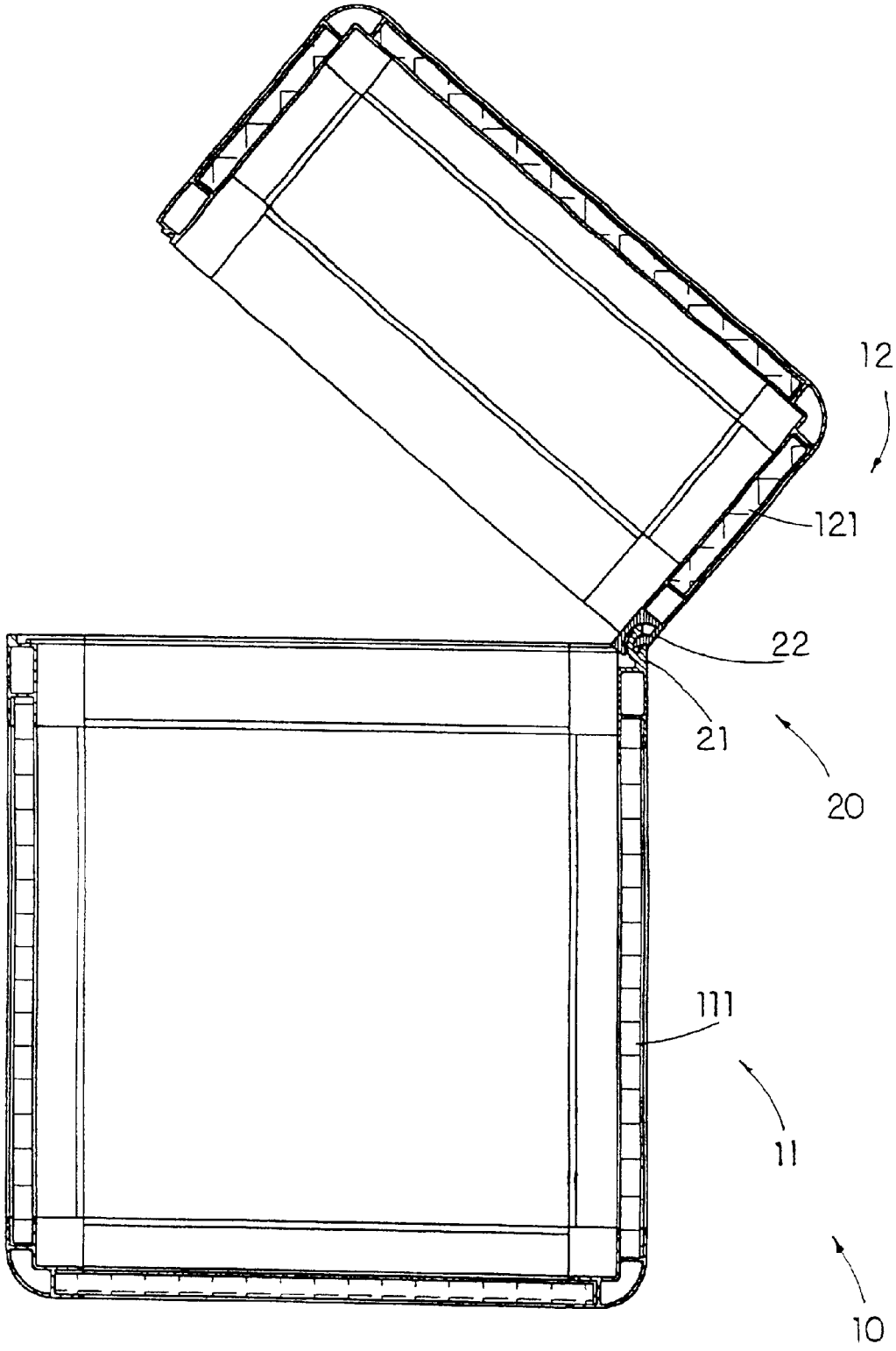
FIG. 3 is a sectional view of a case with a case hinge structure according to a preferred embodiment of the present invention.
Figure 4:
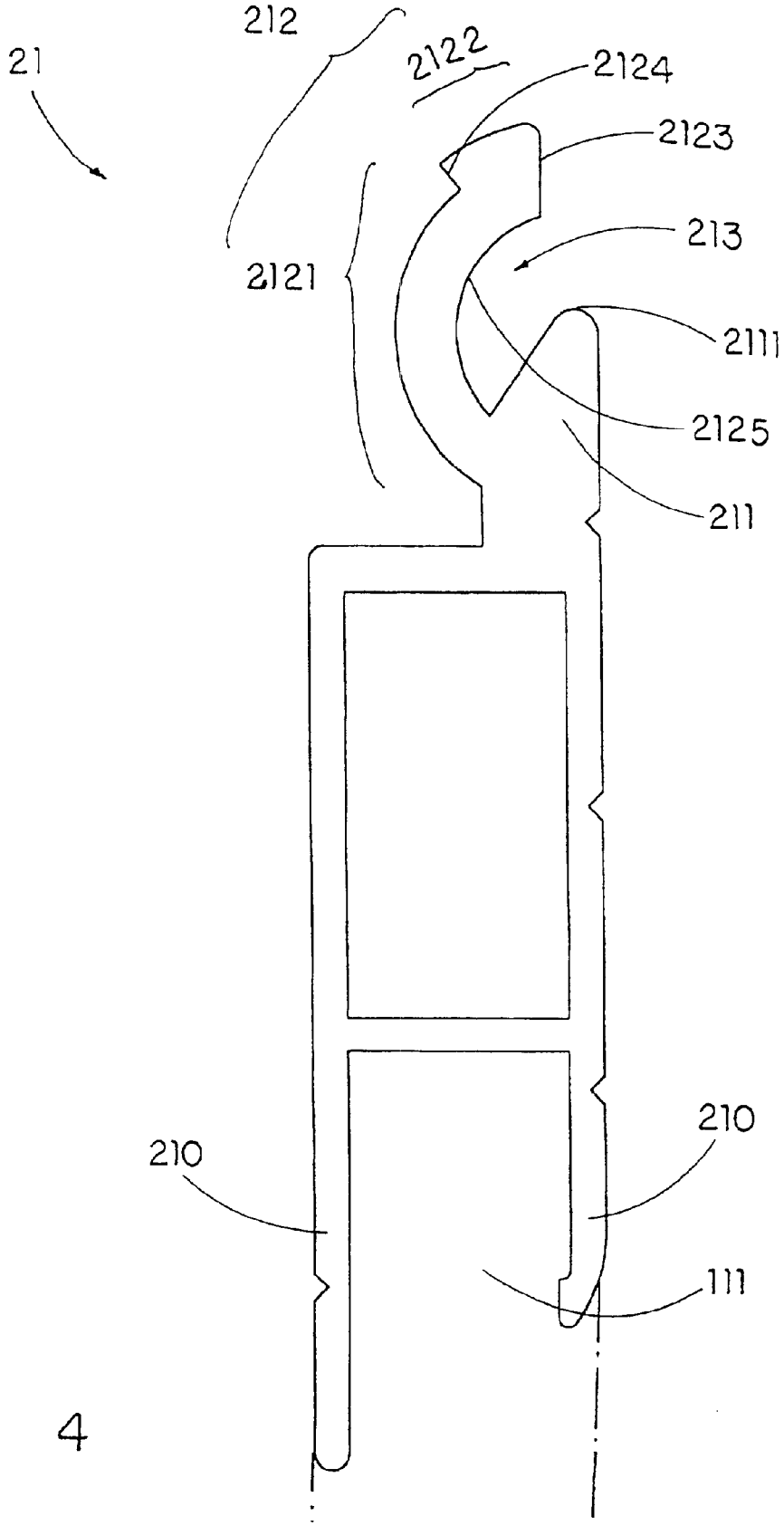
FIG. 4 is a sectional view of a first joint of the case hinge structure according to the above preferred embodiment of the present invention.

As shown in FIG. 5, the first joint 22 comprises a supporting arm 221 having an arc-shaped cross section defining an elongated holding slot 293 therein and, as shown in FIG. 4, the second joint 21 comprises an elongated pivot arm 212 rotatably and pivotally received in the holding slot 223 of the first joint 22 of the hinge structure 20, so as to pivotally connect the case cover 12 with the case body 11.

According to the preferred embodiment as shown in FIGS. 3 to 7, the second joint 21 further comprises a support base 211, wherein the elongated pivot arm 212 of the second joint 21 has an arc-shaped cross section and an elongated support portion 2121 integrally extended from the support base 211 and an enlarged end portion 2122 that defines a front biasing surface 2123 provided at a front end of the end portion 2122 and a rear biasing surface 2124 outwardly extended between the support portion 2121 and the end portion 2122.

As shown in FIG. 10, according to the present embodiment, the first joint 22 further comprises an elongated outer wall 221 and an elongated inner wall 222 to define the elongated holding slot 223 therebetween so as to define a closed stopping surface 224 on the outer wall 221 at an opening end of the holding slot 223 and an opened stopping surface 225 at a closed end thereof, wherein the holding slot 223 has an arc-shaped cross section and a size and curvature arranged for the pivot arm 212 to be pivotally received therein.

Figure 6:
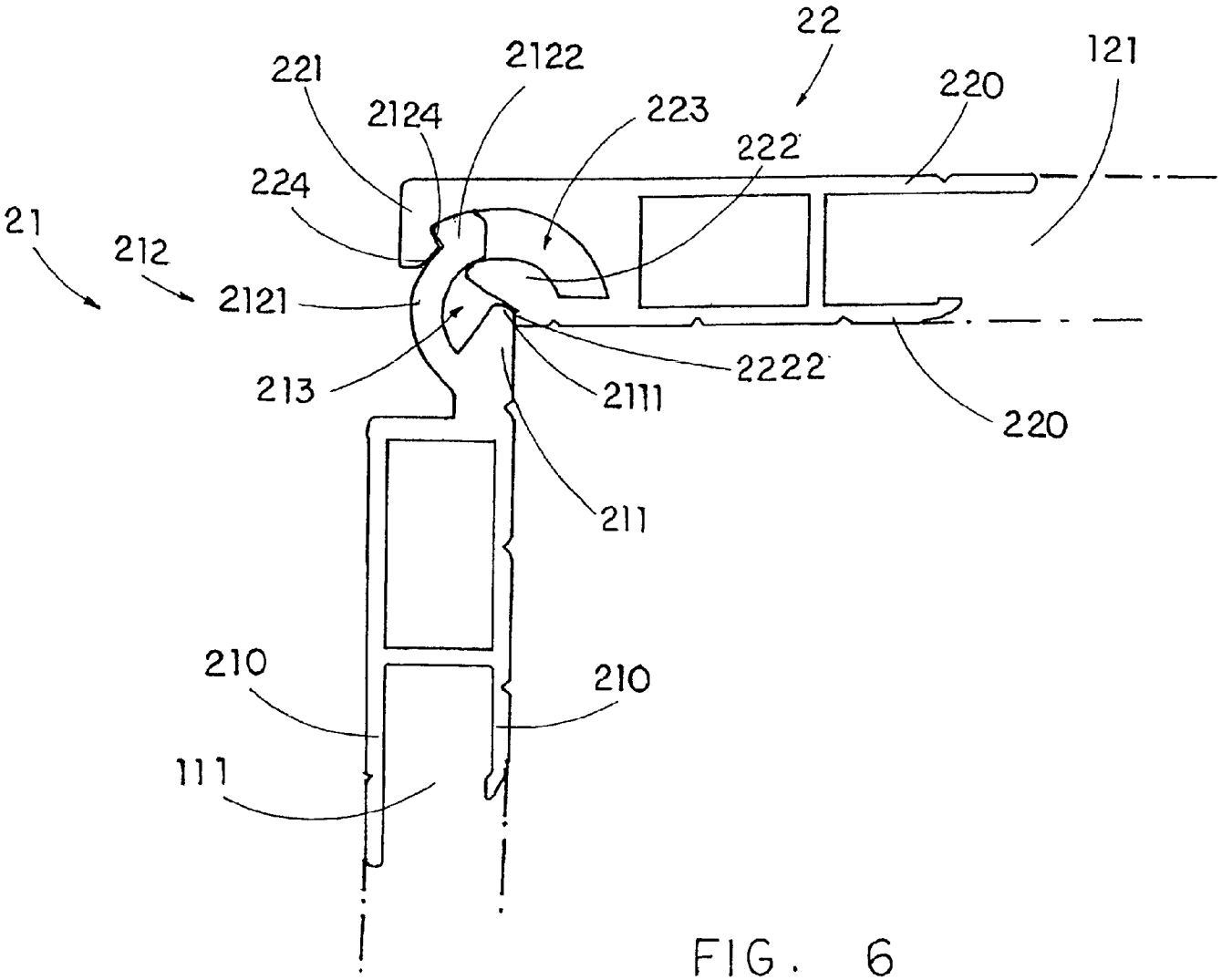
FIG. 6 is a sectional view of the case hinge structure of the case in a closed position according to the above preferred embodiment of the present invention.
Figure 7:
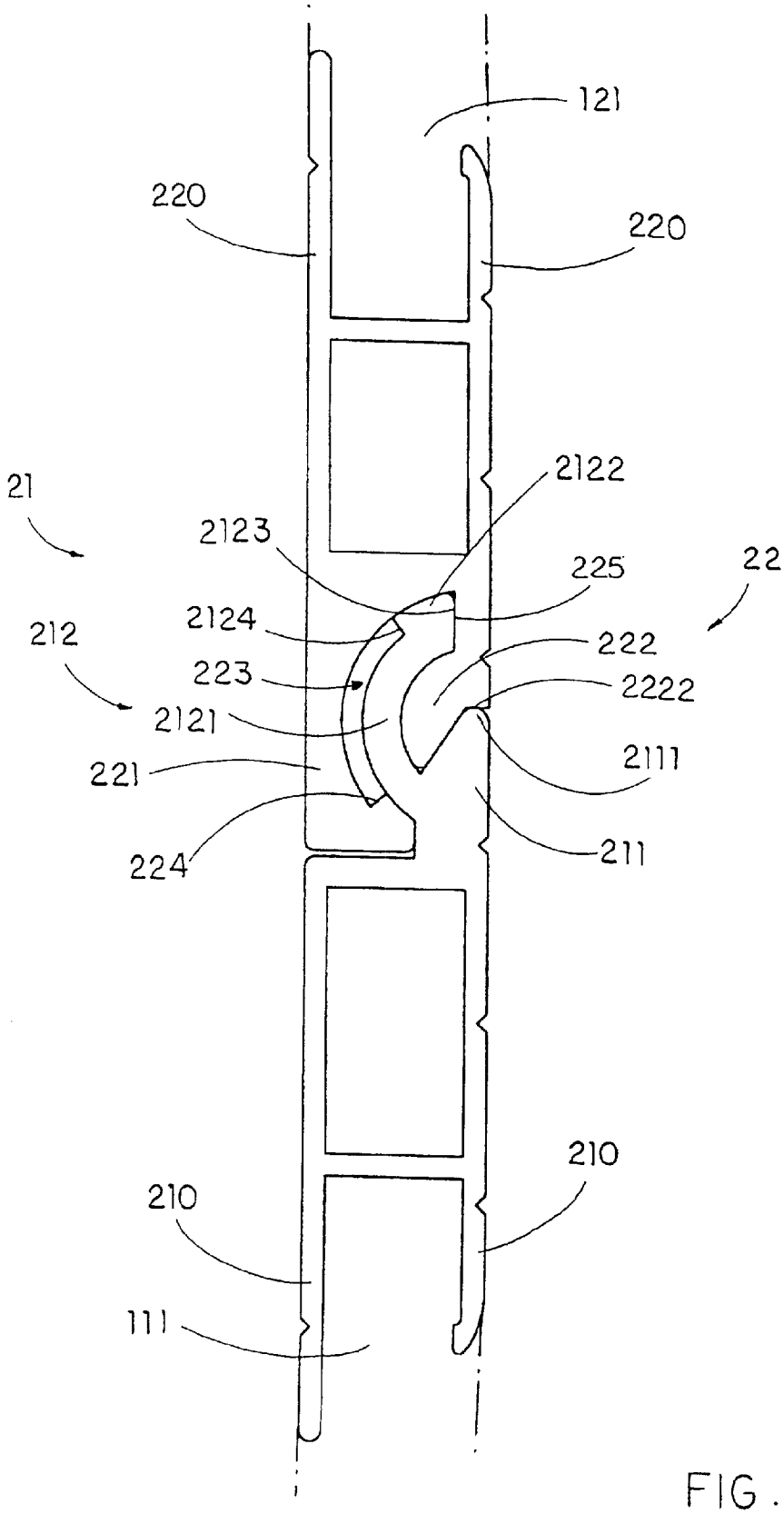
FIG. 7 is a sectional view of the case hinge structure of the case in an opened position according to the above preferred embodiment of the present invention.

The pivot arm 212 is shaped and sized to slidably fit into the holding slot 223 so as to pivotally fold the case cover 12 with respect to the case body 11 between a closed position and an opened position, wherein in the closed position as shown in FIG. 6, the support portion 2121 of the pivot arm 212 is slid out of the holding slot 223 until the rear biasing surface 2124 of the pivot arm 212 is biased against the closed stopping surface 224 of the outer wall 221, and that in the opened position as shown in FIG. 7, the support portion 2121 of the pivot arm 212 is slid into the holding slot 223 until the front biasing surface 2123 of the pivot arm 212 is biased against the opened stopping surface 225 of the holding slot 223.

According to the preferred embodiment, the support portion 2121 of the pivot arm 212 is integrally extended from a lower portion of the support base 211 to define an arc-shaped supporting slot 213 therebetween, wherein the inner wall 222 of the first joint 22 is shaped and sized to slidably fit in the supporting slot 213.

The holding slot 223 has a predetermined curvature to define a traveling distance L between the opened stopping surface 225 and said closed stopping surface 224 of the holding slot 223 that allows said pivot arm 212 sliding along the traveling distance L between the closed position and the opened position of the case cover 12.

Accordingly, at the closed position, as shown in FIG. 6, the case cover 12 is folded to a position that the rear wall 121 of the case cover 12 is perpendicular to the rear panel 111 of the case body 11. Moreover, at the opened position, as shown in FIG. 7, the case cover 12 is folded to a position that the rear wall 121 of the case cover 12 is parallely aligned with the rear panel 111 of the case body 11 in an edge to edge manner. In other words, the hinge structure 20 can provide a 90-degree folding angle for the case cover 12 with respect to the case body 11.

The support base 211 which has a top round end 2111 is biased against the inner wall 222 and functioned as a pivot point of the first joint 22, wherein the inner wall 222 is arranged to slidably move at the top round end 2111 of the support base 211 between the opened position and the closed position.

Accordingly, the inner wall 222 further has a flat positioning surface 2222 slidably biased against the top round end 2111 of the inner wall 222 so as to enhance a folding operation of the case cover 12 with respect to the case body 11.

The pivot arm 212 further has a curved inner surface 2125 having a curvature same as a curvature of a curved inner surface 2221 of the inner wall 222 in such a manner that the inner surface 2125 of the pivot arm 212 is fittedly sliding on the inner surface 2221 of the inner wall 222 in a frictionally movable manner.

In order to connect the first and second joints 22, 21 to the case body 11 and the case cover 12 respectively, the hinge member 21 comprises two first connecting walls 210 and the first joint 22 comprises two second connecting walls 220, wherein the top edge of the rear panel 111 of the case body 11 is securely mounted between the two first connecting walls 210 in a sandwiched manner and a bottom edge of the rear wall 121 of the case cover 12 is securely mounted between the two second connecting walls 220 in a sandwiched manner. Therefore, the first and second joints 21, 22 are firmly connected to the case body 11 and the case cover 12 respectively.

In view of the above disclosure, the case hinge structure of the present invention substantially achieves the following distinctive features and functional results:

(1) The first and second joints are integrally extended from two corresponding panels and internally engaged with each other that it not only protects the hinge structure but also extends the service life span of the case.

(2) Since the first and second joints are integrally extended from the panels respectively, the thickness of the panels can be further reduced. In other words, the structure of the case is no longer restricted by the case hinge structure.

(3) No pin or axle is needed in the pivot connection of the hinge structure, so as to prevent the pin or axle from being broken, which is the major and most easily broken part of the conventional hinge structure.

(4) It can retain the case in the opened position with one or more inclined folding angles such that the case can be easily kept its balance.

(5) The case hinge structure is capable of tightly connecting the case cover with the case body together, so as to prevent a slit formed therebetween.

(6) It can keep an aesthetic appearance of the case since the hinge structure is inconspicuous and cannot be seen from outside.

(7) The manufacturing cost of the case incorporating with the hinge structure is minimized while retaining the original structural design of the case.

What is claimed is:

1. A case, comprising:

a case body having a storage compartment;

a case cover adapted to enclose said storage compartment; and at least a hinge structure comprising a pair of first and second joints extended from a side of said case body and a respective side of said case cover respectively so as to securely connect said case cover with said case body, wherein:

said first joint comprises an elongated supporting arm having an arc-shaped cross section and defining an elongated holding slot therethrough, an elongated outer wall, and an elongated inner wall, wherein said holding slot is defined between said elongated outer wall and said elongated inner wall, so as to define a closed stopping surface on said outer wall at an opening end of said holding slot and an opened stopping surface at a closed end thereof, and said second joint comprises an elongated pivot arm pivotally received in and extended along said holding slot of said first joint, wherein said case cover is capable of folding up and down with respect to said case body to open and close said case by pivotally rotating said pivot arm of said second joint within and about said supporting arm of said first joint, wherein said second joint further comprises a support base and said elongated pivot arm of the second joint has an arc-shaped cross section and an elongated support portion integrally extended from said support base and an enlarged end portion that defines a front biasing surface provided at a front end of said end portion and a rear biasing surface outwardly extended between said support portion and said end portion;

wherein said holding slot has an arc-shaped cross section and a size and curvature arranged for said pivot arm to be pivotally received therein, so as to enable said case cover to be pivotally folded with respect to said case body between a closed position and an opened position, wherein in said closed position, said support portion of said pivot arm is slid out of said holding slot until said rear biasing surface of said pivot arm is biased against said closed stopping surface of said outer wall, and that in said opened position, said support portion of said pivot arm is slid into said holding slot until said front biasing surface of said pivot arm is biased against said opened stopping surface of said holding slot, wherein said support base has a top round end and is biased against said inner wall and functions as a pivot point of said second joint, wherein said inner wall is arranged to slidably move at said top round end of said support base between said opened position and said closed position, wherein said inner wall further has a flat positioning surface slidably biased against said top round end of said inner wall so as to enhance a folding operation of said case cover with respect to said case body.

2. The case, as recited in claim 1, wherein said holding slot defines a traveling distance between said opened stopping surface and said closed stopping surface of said holding slot that allows said supporting arm to slide along said traveling distance between said closed position and said opened position of said case cover.

3. The case, as recited in claim 1, wherein said supporting arm further has a curved inner surface having a curvature the same as a curvature of a curved inner surface of said inner wall in such a manner that said inner surface of said supporting arm is fittedly sliding on said inner surface of said inner wall in a frictionally movable manner.

4. The case, as recited in claim 2, wherein said supporting arm further has a curved inner surface having a curvature the same as a curvature of a curved inner surface of said inner wall in such a manner that said inner surface of said supporting arm is fittedly sliding on said inner surface of said inner wall in a frictionally movable manner.

5. The case, as recited in claim 1, wherein each of said first and second joints comprises two connecting walls for respectively mounting a rear panel of said case body and a rear wall of said case cover between said two connecting walls in a sandwiched manner.

6. The case, as recited in claim 2, wherein each of said first and second joints comprises two connecting walls for respectively mounting a rear panel of said case body and a rear wall of said case cover between said two connecting walls in a sandwiched manner.

7. The case, as recited in claim 3, wherein each of said first and second joints comprises two connecting walls for respectively mounting a rear panel of said case body and a rear wall of said case cover between said two connecting walls in a sandwiched manner.

8. The case, as recited in claim 4, wherein each of said first and said second joints comprises two connecting walls for respectively mounting a rear panel of said case body and a rear wall of said case cover between said two connecting walls in a sandwiched manner.

* * * * *